US006343750B1

(12) United States Patent
Engel

(10) Patent No.: US 6,343,750 B1
(45) Date of Patent: Feb. 5, 2002

(54) SHOWER HEAD

(76) Inventor: Ray C. Engel, 2351 Tenava Dr., Modesto, CA (US) 95354

( * ) Notice: Subject to any disclaimer, the term of this patent is extended or adjusted under 35 U.S.C. 154(b) by 0 days.

(21) Appl. No.: 09/676,129

(22) Filed: Sep. 29, 2000

(51) Int. Cl.[7] ..... B05B 1/34; B05B 15/08
(52) U.S. Cl. ..... 239/463; 239/587.3; 239/587.4
(58) Field of Search ..... 239/587.3, 587.4, 239/463

(56) References Cited

U.S. PATENT DOCUMENTS 2,560,279 A * 7/1951 Curtis ..... 239/587.3 X
4,275,843 A * 6/1981 Moen ..... 239/587.3
4,801,094 A * 1/1989 Gonzalez ..... 239/587.3 X
5,143,298 A * 9/1992 Prokopoff ..... 239/587.3 X

* cited by examiner

*Primary Examiner*—Lesley D. Morris
(74) *Attorney, Agent, or Firm*—Tod R. Nissle, P.C.

(57) ABSTRACT

A shower head operates under low water pressure. The shower head utilizes a unitary ball. The ball includes a vaned member integrally formed in a passageway through the ball. The vaned member includes a plurality of spaced apart helical arms coterminating at an intermediate rounded spherically shaped surface which evenly distributes water intermediate the helical arms. Water from the vaned member discharges into a large vortex chamber and from the vortex chamber through a smaller venturi-like aperture which accelerates the water past aeration ports.

4 Claims, 3 Drawing Sheets

FIG. 2
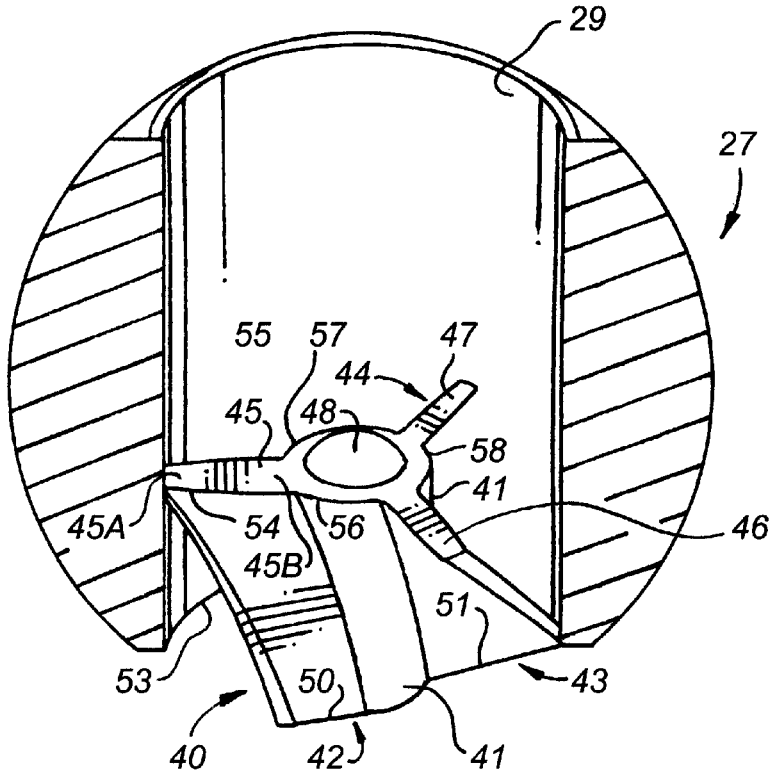
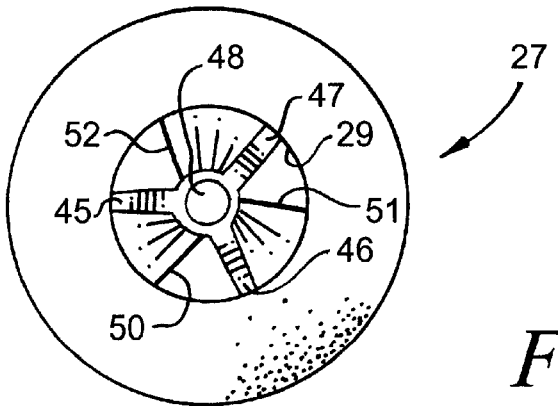
FIG. 3

SHOWER HEAD

This invention pertains to shower heads.

More particularly, the invention pertains to a water conserving shower head which operates quietly, produces a relatively full pattern of water droplets, and in use consumes a minimal amount of water.

At relatively low water pressures, many conventional shower heads do not function well. As a result, shower heads are utilized which can operate under the force of gravity, but which also, unfortunately, consume large volumes of water.

One problem associated with designing a shower head which can be utilized at low water pressures is noise. If a shower head makes an irritating noise while operating, the commercial value of the shower head is questionable, at best.

Another problem associated with designing a shower head which can be utilized at low water pressures is the spray pattern produced by the shower head. If the water droplets produced are too large or too small, the practical value of the shower head can be severely diminished. In addition, if a portion of the normal conical shower head droplet pattern is missing, of if there are no water droplets in the central area of the conical droplet pattern, the commercial value of the shower head can be minimal.

It is difficult to produce a shower head which meets each criterion of (1) minimizing water consumption, (2) being usable under varying water pressures, (3) operating quietly, (4) producing a conical shower droplet pattern including droplets of the appropriate size, and (5) producing a conical shower droplet pattern which is complete and does not have portions of the conical pattern missing.

Small changes in the physical dimensions of the path along which water flows through a shower head can have a significant impact on each of the foregoing criteria and, worse, can deleteriously affect some criteria while improving others.

Accordingly, it would be highly desirable to provide a water conserving shower head which would meet each of the criteria noted above.

Therefore, it is a principal object of the invention to provide an improved water conserving shower head.

These and other, further and more specific objects and advantages of the invention will be apparent to those skilled in the art from the following detailed description thereof, taken in conjunction with the drawings, in which:

FIG. 2 is a perspective section view illustrating the unitary ball structure of the invention, including the vortex forming vaned member formed in the ball;

FIG. 3 is a top view of the unitary ball structure of FIG. 2; and,

Figure 1:
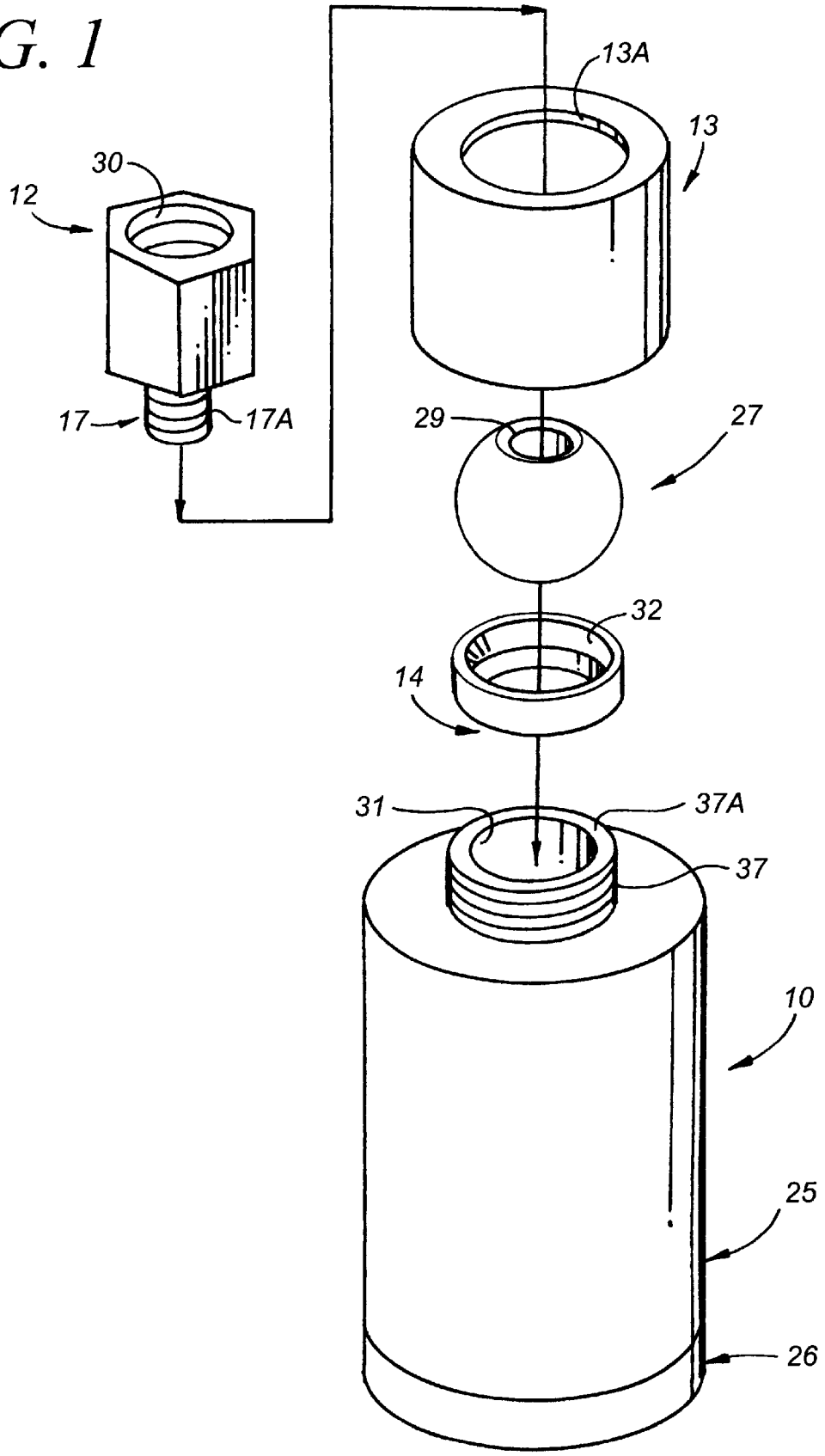
FIG. 1 is an exploded assembly perspective view illustrating a shower head constructed in accordance with the principles of the invention.

Briefly, in accordance with the invention, I provide an improved shower head. The shower head includes a first portion adapted to be attached to a water supply and a spray head pivotally attached to the first portion. The improvements direct water from the first portion into the spray head in a swirling direction. The improvements include a socket in the spray head; and, a unitary ball in the first portion and mounted in the socket to permit the spray head to pivot on the first portion. The unitary ball includes a spherical outer contact surface engaging the socket such that when the spray head is pivoted the socket slides over at least a portion of the spherical outer contact surface; includes a channel formed through the ball and in fluid communication with the water supply and the shower head; and, includes a vortex forming structure in the channel in a fixed selected orientation to impart a swirling vortex motion to water passing through the vortex forming structure. The vortex forming structure includes a plurality of spaced apart radially extending vanes.

In another embodiment of the invention, I provide an improved shower head including a first portion adapted to be attached to a water supply and a spray head attached to the first portion. The improvements direct water from the first portion into the spray head in a swirling direction. The improvements include a mounting structure in the spray head; a water input orifice formed in the first portion and in fluid communication with the water supply; and, a vortex forming structure in the first portion and mounted in the mounting means. The vortex forming structure includes a vortex forming member including a plurality of spaced apart radially extending vanes for imparting a swirling vortex motion to water passing through the vortex forming member and over the vanes. Each of the vanes includes an upper surface. The upper surface is the portion of said vane closest to the orifice. The distance from the upper surface of each vane to the orifice is in the range of 0.090 inch to 0.190 inch. The vortex forming structure also includes a channel extending from the orifice to the vortex forming member to direct water from the orifice through the vortex forming member; and, includes a smooth rounded surface intermediate the vanes and extending outwardly away from the vanes toward the orifice. The distance from the rounded surface to the orifice is in the range of 0.030 to 0.130 inch.

In a further embodiment of the invention, I provide an improved shower head comprising a first portion adapted to be attached to a water supply and a spray head attached to the first portion. The improvements in the shower head direct water from the first portion into the spray head in a swirling direction. The improvements include a vortex chamber in the spray head; a water input orifice formed in the first portion and in fluid communication with the water supply; a vortex forming structure in the first portion; and, a channel in the first portion extending from the orifice to the vortex forming means to direct water from the orifice through the vortex forming means and into the vortex chamber. The vortex forming structure includes a hub; and, a plurality of spaced apart vanes extending outwardly from the hub for imparting a swirling vortex motion to water passing through the vortex forming structure and over the vanes. Each of the vanes includes an upper surface. The upper surface tapers outwardly away from the hub and terminates at at least one edge. The edge is rounded to minimize turbulence caused when water flows over the edge. The vortex forming structure also includes a smooth rounded surface on the hub intermediate the vanes and extending outwardly away from the vanes toward the orifice.

In still another embodiment of the invention, I provide an improved shower head comprising a first portion adapted to be attached to a water supply and a spray head attached to the first portion. The improvements direct water from the first portion into the spray head in a swirling direction. The improvements include a vortex chamber in the spray head; a water input orifice formed in the first portion and in fluid communication with the water supply; a vortex forming structure in the first portion; and, a channel in the first portion extending from the orifice to the vortex forming structure to direct water from the orifice through the vortex forming structure and into the vortex chamber. The vortex forming structure includes a hub; a plurality of spaced apart vanes outwardly extending from said hub for imparting a swirling vortex motion to water passing through the vortex forming structure and over the vanes; and, a smooth rounded surface on the hub intermediate the vanes. The smooth rounded surface extends outwardly away from the vanes toward the orifice a distance in the range of 0.040 to 0.080 inch; and, has a width in the range of 0.120 to 0.190 inch.

In a further embodiment of the invention, I provide an improved shower head comprising a first portion adapted to be attached to a water supply and a spray head pivotally attached to the first portion. The improvements in the shower head direct water from the first portion into the spray head in a swirling direction. The improvements include a socket in the spray head; a vortex chamber in the spray head, the vortex chamber having a depth in the range of 0.60 to 0.80 inch; a unitary ball structure in the first portion and mounted in the socket to permit the spray head to pivot on the first portion. The unitary ball structure includes a spherical outer contact surface engaging the socket such that when the spray head is pivoted the socket slides over at least a portion of the spherical outer contact surface. The unitary ball structure also includes a channel formed through the ball structure and in fluid communication with the water supply and the vortex chamber in the shower head. The channel includes an opening adjacent the vortex chamber. The ball structure also includes a vortex forming structure formed in the channel in a fixed selected orientation to impart a swirling vortex motion to water passing through the vortex forming structure into the vortex chamber. The vortex forming structure includes a plurality of spaced apart radiating vanes each terminating at the opening of the channel adjacent the vortex chamber.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 is an assembly view of a shower head constructed in accordance with the invention and including a first portion adapted to be attached to a water supply and a spray head 10 pivotally attached to the first portion. The first portion includes internally threaded orifice member 12, collar 13 with lip 13A, unitary ball structure 27, and, elastic cylindrical rubber seal 14 with tapered conical surface 32.

Orifice member 12 includes internal threads 30 which turn onto the external thread 15 of the conduit in a shower which supplies water to the shower head. Member 12 also includes nose 17. Nose 17 includes external serrations 17A. Nose 17 is press fit into channel 29 of ball structure 27 in the manner illustrated in FIG. 4. Serrations 17A are sized such that they function to lock nose 17 in cylindrical aperture 29 when nose 17A is press fit into channel 29. Orifice 18 is formed in member 12 and extends through nose 17 in the manner illustrated in FIG. 4. Water from conduit 15 travels into the input end of orifice 18, travels through orifice 18, and travels through the output end of orifice 18 into channel 29 toward vortex forming structure 40 (FIG. 2). Petcock 16 is mounted in member 12 and is used to regulate the flow of water traveling from conduit 15 through orifice 18.

Figure 4:
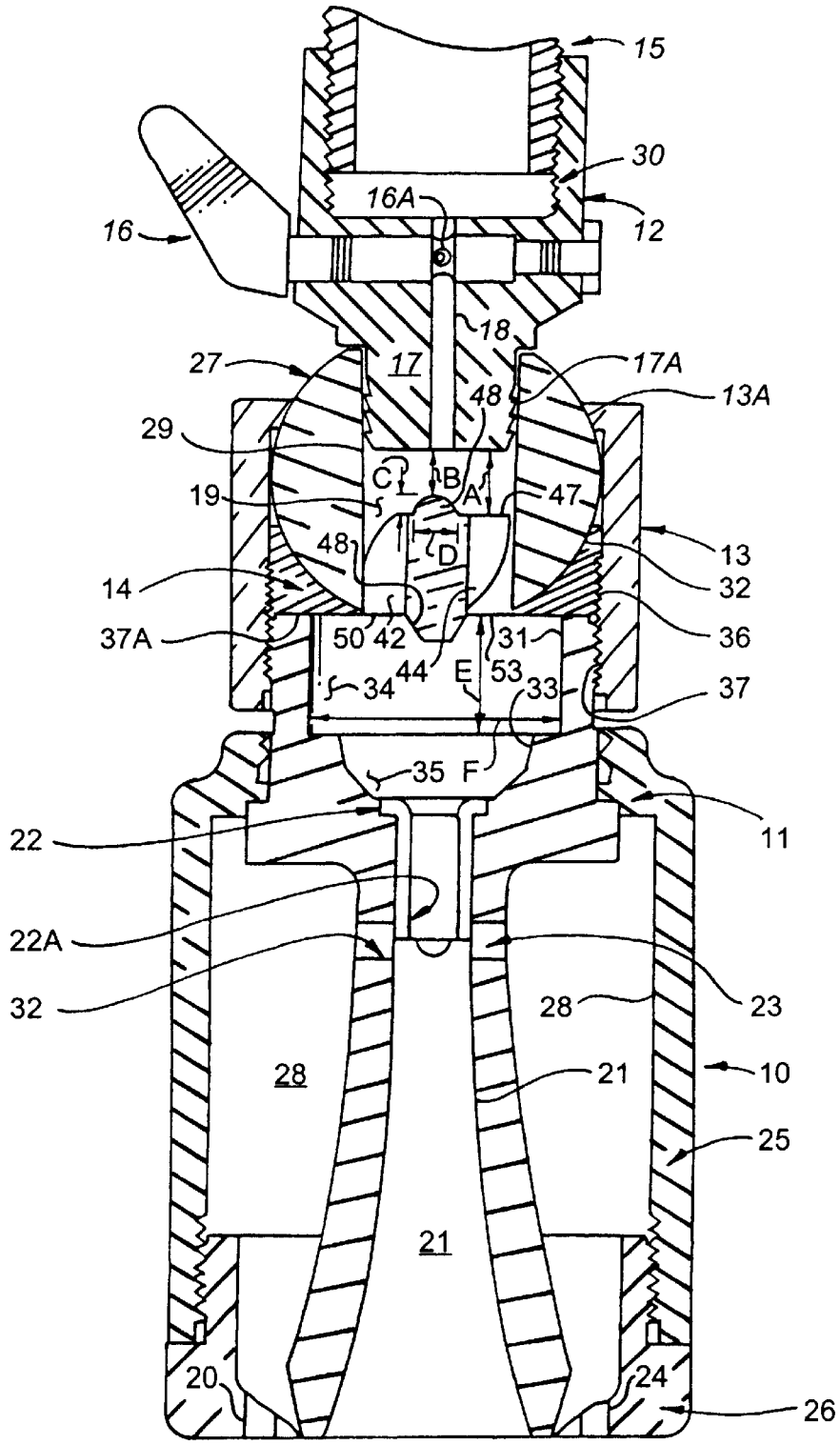
FIG. 4 is a section view of the shower head of FIG. 1 after assembly and further illustrating construction details thereof.

Ball structure 27 seats against lip 13A of collar 13 in the manner shown in FIG. 4 such that lip 13A slides over outer spherical surface 27 when spray head 10 is manually grasped and pivoted on ball structure 27. Ball structure 27 remains in fixed position when spray head 10 is pivoted on structure 27.

When internal threads 36 of collar 13 are turned onto the external thread 37 of the neck of spray head 10, lip 37A compresses seal 14 against a portion of the outer spherical surface 27 as depicted in FIG. 4.

Spray head 10 includes hollow cylindrical member 22 having cylindrical aperture 22A and includes member 11 provided with passageway 21. Apertures 23, 32 and 20, 24 permit air to be drawn into hollow areas in head 10 and into the stream of water which exits aperture 22A and flows into diverging conical passageway 21 of head 10. Inner cylindrical wall 28 circumscribes member 11. Lower end 26 of head 10 threads into hollow housing 25. Housing 25 includes inner cylindrical wall 28. Member 11 includes the neck which includes external threads 37.

FIGS. 2 and 3 further illustrate the construction of unitary ball structure 27. Ball structure 27 includes vortex forming structure 40. While parts of the ball structure can be manufactured separately and then assembled in the shower head, the ball structure 27 is presently preferably molded at one time or otherwise constructed to produce a unitary ball structure 27 which comprises one assembled piece and is utilized as one piece when the show head of the invention is assembled. This construction is believed to be critical in the practice of the invention because many hours of experimentation were required to determine the configuration of the shower head of the invention and because specific tolerances are required for the shower head to function efficiently. When the components of the ball structure 27 are provided separately and are assembled during assembly of the showerhead, tolerance errors can be introduced.

Structure 40 includes cylindrical hub 41 and a plurality of vanes 42 to 44 radially helically extending from hub 40 to channel 29. Each vane tapers as the vane extends outwardly from hub 40. For example, the portion 45B of the surface 45 of vane 42 which is adjacent hub 40 is wider than the portion 45A of vane 42 which is further away from hub 40.

Vane 42 includes upper surface 45. Surface 45 terminates in part at spaced apart edges 54 and 55 which bound surface 45. Vane 43 includes upper surface 46. Surface 46, like surface 45, terminates in part at a pair of spaced apart edges which bound surface 46. Surface 47, like surface 45, terminates in part at a pair of spaced apart edges which bound surface 47. The pair of spaced apart edges which bound each surface 45 to 47 are preferably rounded and smooth, i.e., each of the edges has a "radius" and is not a sharp edge. Rounded surface 48 is formed on hub 41 intermediate vanes 42 to 44 and intermediate surfaces 45 to 47. Hub 41 includes arcuate edges 56 to 58 each extending intermediate a pair of vanes 42 to 44. Each edge 56 to 58 is preferably rounded and smooth, i.e., each of the edges has a "radius" and is not a sharp edge.

The rounded opposing edges bounding each surface 45 to 47, the rounded edges 56 to 58, the tapering of vanes 42 and 44 as they extend outwardly from hub 41, and the hemispherical rounded surface 48 are important in producing a showerhead which is quiet, which can be utilized at low water pressure, which conserves water, and which produces a conical water droplet pattern that includes water droplets fairly evenly dispersed throughout the pattern.

One critical dimension in the practice of the invention is the distance, indicated by arrows B, from the top of rounded surface 48 to the outlet end of orifice 48. This distance is preferably in the range of 0.030 to 0.130 inch. If the distance B is greater than 0.130 inch, the spray pattern can become irregular when the spray head 10 is pivoted on ball structure 27. The pattern becomes irregular when a portion of the conical pattern is lost, i.e., if, for example, one-half of the conical droplet pattern is lost and the droplets exiting the shower head only form one-half of a cone. The pattern also becomes irregular if it is "hollow" because there are few, if any, water droplets in the center of the conical pattern. If the distance B is less than 0.030 inch, the flow rate decreases and the noise produced by the shower head increases.

Another critical dimension is the distance, indicated by arrows A, from the top surfaces 45 to 47 to the outlet end of orifice 48. This distance is preferably in the range of 0.090 to 0.190 inch.

Other critical dimensions which affect the noise produced by the showerhead and affect the spray pattern are the width and height of rounded surface 48. The width, indicated by arrows D, of surface 48 is preferably in the range of 0.120 to 0.190. The height, indicated by arrows C, of surface 48 is preferably in the range of 0.040 to 0.080 inch.

Still another critical dimension in the practice of the invention is the height, indicated by arrows E, of the cylindrical vortex chamber circumscribed by wall 31. Wall 31 circumscribes space 34. The height E of the vortex chamber is in the range of 0.60 to 0.80 inch.

Yet another important feature of the invention is that the lower edges of vanes 42 to 44 terminate at the same point as the lower circular end or outlet 50 of channel 29. If the lower edges of vanes 42 to 44 extend down into the vortex chamber they interfere with the swirling motion produced by vortex forming structure 40. If in FIG. 4, the lower edges of vanes 42 to 44 terminate inside channel 29 at points spaced upwardly away from the outlet 50, the swirling motion of water exiting structure 40 would slow due to frictional contact with channel 29. It is preferable that water existing structure 40 enter immediately into the vortex chamber.

Still a further important feature of the invention is that the diameter or width of the vortex chamber must be greater than the diameter or width of channel 20 and structure 40. The expansion of the swirling water produced by structure 40 into the vortex chamber and the subsequent venturi-like constriction of the water passage into channel 22A appears central to the construction of the shower head of the invention. The diameter F of the vortex chamber is in the range of 0.65 to 0.86 inch. The diameter of channel 29 is in the range of 0.4 to 0.6 inch.

In use, pet cock 16 is turned such that opening 16A formed through pet cock 16 permits water from supply conduit 15 to flow through opening 16A into orifice 18 to exit via the outlet end of orifice 18 into channel 29. Water supplied by orifice 18 flows through channel 29 and vortex forming structure 40. Water exiting structure 40 swirls into vortex chamber space 34, through space 35, through aperture 22A, into conical passageway 21, and exits passageway to form a generally conical pattern of water droplets. As earlier noted, water exiting aperture 22A draws in air through apertures 32 to aerate the water. Space 35 is circumscribed by generally conical wall 33.

As would be appreciated by those of skill in the art, means other than serrations 17 can be utilized to fix nose 17 in aperture 29. For example, nose 17 can be externally threaded, and aperture 29 can be internally threaded. Or adhesive can be utilized, etc.

Having described my invention in such terms as to enable those of skill in the art to make and practice it, and having described the presently preferred embodiments thereof, I claim:

1. In a shower head comprising a first portion adapted to be attached to a water supply and a spray head attached to said first portion, the improvements for directing water from the first portion into the spray head in a swirling direction, the improvements including (a) mounting means in the spray head;

(b) a water input orifice formed in the first portion and in fluid communication with the water supply;

(c) vortex forming means in said first portion and mounted in said mounting means, said vortex forming means including (i) a vortex forming member including a plurality of spaced apart radially extending vanes for imparting a swirling vortex motion to water passing through said vortex forming member and over said vanes, each of said vanes including an upper surface, said upper surface being the portion of said vane closest to said orifice, the distance from said upper surface of each vane to said orifice being in the range of 0.090 inch to 0.190 inch, (ii) a channel extending from said orifice to said vortex forming member to direct water from said orifice through said vortex forming member, (iii) a smooth rounded surface intermediate said vanes and extending outwardly away from said vanes toward said orifice, the distance from said rounded surface to said orifice being in the range of 0.030 to 0.130 inch.

2. In a shower head comprising a first portion adapted to be attached to a water supply and a spray head attached to said first portion, the improvements for directing water from the first portion into the spray head in a swirling direction, the improvements including (a) a vortex chamber in the spray head;

(b) a water input orifice formed in the first portion and in fluid communication with the water supply;

(c) vortex forming means in the first portion;

(d) a channel in the first portion extending from said orifice to said vortex forming means to direct water from said orifice through said vortex forming means and into said vortex chamber, said vortex forming means including (e) a hub;

(f) a plurality of spaced apart vanes extending outwardly from said hub for imparting a swirling vortex motion to water passing through said vortex forming member and over said vanes, each of said vanes including an upper surface, said upper surface (i) tapering outwardly away from said hub, (ii) terminating at at least one edge, said edge being rounded to minimize turbulence cause when water flows over said edge; and, (g) a smooth rounded surface on said hub intermediate said vanes and extending outwardly away from said vanes toward said orifice.

3. In a shower head comprising a first portion adapted to be attached to a water supply and a spray head attached to said first portion, the improvements for directing water from the first portion into the spray head in a swirling direction, the improvements including (a) a vortex chamber in the spray head;

(b) a water input orifice formed in the first portion and in fluid communication with the water supply;

(c) vortex forming means in the first portion;

(d) a channel in the first portion extending from said orifice to said vortex forming means to direct water from said orifice through said vortex forming means and into said vortex chamber, said vortex forming means including (e) a hub;

(f) a plurality of spaced apart vanes extending outwardly from said hub for imparting a swirling vortex motion to water passing through said vortex forming member and over said vanes, and, (g) a smooth rounded surface on said hub intermediate said vanes, said smooth rounded surface (i) extending outwardly away from said vanes toward said orifice a distance in the range of 0.040 to 0.080 inch, and (ii) having a width in the range of 0.120 to 0.190 inch.

4. In a shower head comprising a first portion adapted to be attached to a water supply and a spray head pivotally attached to said first portion, the improvements for directing water from the first portion into the spray head in a swirling direction, the improvements including (a) socket means in the spray head;

(b) a vortex chamber in the spray head and having a depth in the range of 0.60 to 0.80 inch;

(c) unitary ball means in said first portion and mounted in said socket means to permit the spray head to pivot on the first portion, said unitary ball means including (i) a spherical outer contact surface engaging said socket means such that when the spray head is pivoted said socket means slides over at least a portion of said spherical outer contact surface, (ii) a channel formed through said ball means and in fluid communication with the water supply and said vortex chamber in the shower head, said channel including an opening adjacent said vortex chamber, (iii) vortex forming means integrally formed in said channel in a fixed selected orientation to impart a swirling vortex motion to water passing through said vortex forming means into said vortex chamber, said vortex forming means including a plurality of spaced apart radially extending vanes each terminating at said opening of said channel adjacent said vortex chamber.

* * * * *